United States Patent [19]

Hehlo

[11] 4,258,734

[45] Mar. 31, 1981

[54] PERSONAL CARE APPLIANCE

[76] Inventor: Lloyd G. Hehlo, 161 Turnpike Rd., East Brunswick, N.J. 08816

[21] Appl. No.: 46,483

[22] Filed: Jun. 7, 1979

[51] Int. Cl.[3] ..... A45D 29/18

[52] U.S. Cl. ..... 132/74.5

[58] Field of Search ..... 132/74.5, 9; 15/22 R; 128/62 A, 62 R; 206/228

[56] References Cited

U.S. PATENT DOCUMENTS

| | | | |
|---|---|---|---|
| 1,466,474 | 8/1923 | Hatcher et al. | 128/62 A |
| 1,584,695 | 5/1926 | Palmer | 128/62 R |
| 1,692,047 | 11/1928 | Moore | 128/62 A |
| 2,187,560 | 1/1940 | Reilly | 128/62 A |
| 2,299,627 | 10/1942 | Hunter et al. | 132/74.5 |

FOREIGN PATENT DOCUMENTS

| | | | |
|---|---|---|---|
| 1062257 | 12/1953 | France | 132/74.5 |

*Primary Examiner*—G. E. McNeill

*Attorney, Agent, or Firm*—Cooper, Dunham, Clark, Griffin & Moran

[57] ABSTRACT

A personal care appliance useful as a manicure device or the like which comprises a water jet nozzle, means for supplying liquid under pressure to the nozzle to form a liquid jet, and a spray shield at least partially surrounding the water jet nozzle. The spray shield preferably is substantially cylindrical or oblate in form and is provided with an open area or part of sufficient size and shape that a digit may be inserted.

4 Claims, 5 Drawing Figures

PERSONAL CARE APPLIANCE

This invention relates to an apparatus to promote human hygiene. In one of its more specific aspects, it relates to a manicure or pedicure device for cleaning fingernails or toenails.

The working environment of many persons and the environment of most recreational facilities regularly results in the deposit of grease and grime on the hands and feet and under the nails of fingers and toes. Manual cleaning of fingernails or toenails is often time consuming and relatively ineffective.

This invention provides a simple and effective nail cleaning apparatus that applies a liquid jet to the ends of the user's fingers or toes, and more particularly, to the exposed undersurface of the user's fingernails or toenails.

The use of liquid jets in dental hygiene is already well known. Various appliances, such as that disclosed in U.S. Pat. No. 3,809,977, make use of a water jet for cleaning teeth and gingival surfaces. Also, a device employing a pulsating liquid jet, directed at the ends of the fingers to clean the hands and nails and to soften the cuticle surrounding the fingernail is disclosed in U.S. Pat. No. 4,020,856.

The apparatus of this invention comprises a water jet nozzle designed for insertion beneath the nail to separate the exposed portion of the underside of the nail from the tip of the digit, i.e., the finger or toe, and to direct a stream of water against the underside of the exposed portion of the nail. Water is supplied under pressure from a source of liquid supply to the nozzle to form a liquid jet upon exiting the nozzle. A spray shield substantially enclosing the water jet nozzle is provided with a port or open area of sufficient size and shape that a finger or toe may be inserted therein, the spray shield and digit thereby defining a substantially enclosed cavity around the tip of the digit. A handle member may be provided for holding the device and directing the liquid jet. In a preferred embodiment of the apparatus, a finger pressure operated valve is incorporated in the handle.

A preferred embodiment of the apparatus of this invention is illustrated in the accompanying drawing.

Figure 1:
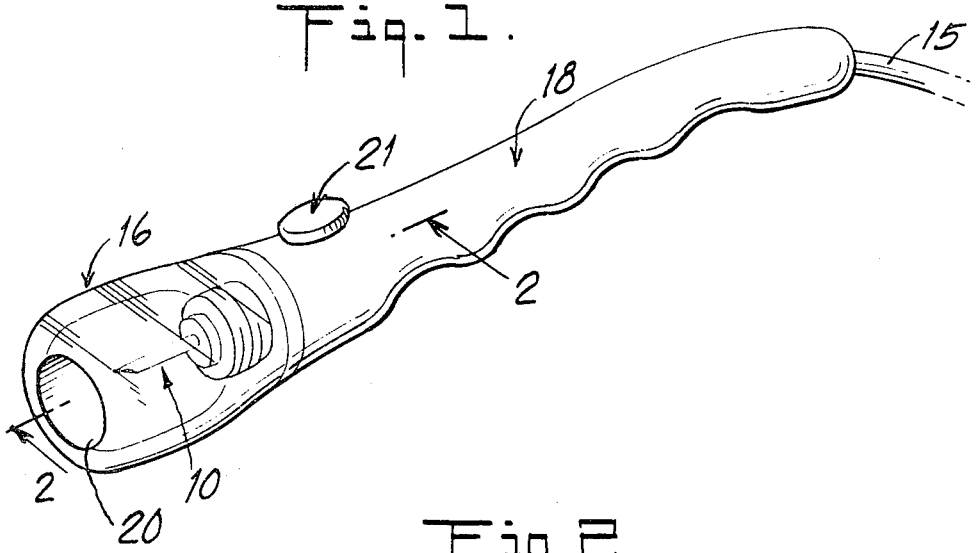
FIG. 1 is a perspective view of a personal care appliance in accordance with the present invention.

With reference to the drawings, the nail care appliance of the present invention includes a water jet nozzle 10 provided with a tapered end section 11 and having a beveled section 12 at its outlet end to permit easy insertion under a nail and to direct the cleansing liquid into the crevice between the nail and the finger tip. The nozzle 10 is detachably connected to a handle member 18, described hereinafter, suitably by a snap-in, snap-out arrangement well known in the art comprising a male connector 13 and O-ring seal 14 in the end wall 19 of handle member 18. Conduit means, such as hose 15, is attached to the nozzle for conducting cleansing liquid, e.g., water, under pressure, from a suitable source of supply as, for example, a mechanical pump, household water faucet, or the like.

A spray shield 16 surrounds the water jet nozzle. This spray shield is detachably connected with handle member 18, suitably by means of screw threads 17. The spray shield is provided with a port 20 of sufficient size and shape that a digit may be inserted therein. The spray shield and digit thereby define a substantially enclosed cavity around the finger, or toe. In use, a digit is inserted into the opening, and the nozzle is so positioned relative to the nail that liquid passing through the nozzle is directed at and under the fingernail or toenail and dissolves, disperses, or otherwise dislodges grease or dirt which is lodged under and around the nail. Interchangeable shields and nozzles of varying sizes and shapes may be provided to permit insertion of a finger or toe comfortably without excessive open area around a digit.

Spray shield 16 is preferably transparent so that, during operation and use, the action of the jet can be observed and the position of the finger or toe being cleaned can be adjusted relative to the position of the jet. Accordingly, the spray shield typically comprises a transparent plastic material, for example, a polymer or copolymer of acrylic acid, methacrylic acid, esters of these acids, acrylonitrile or styrene.

The shape of the spray shield 16 is such that a digit can be easily inserted therein and removed therefrom. Also, the shape should permit some movement of the finger or toe so that its position relative to the position of the jet can be varied to effect optimal cleaning action. Desirably, the shape should also minimize the splattering of excess liquid. For these reasons, generally spherical and oblate spray shields are usually preferred.

Figure 2:
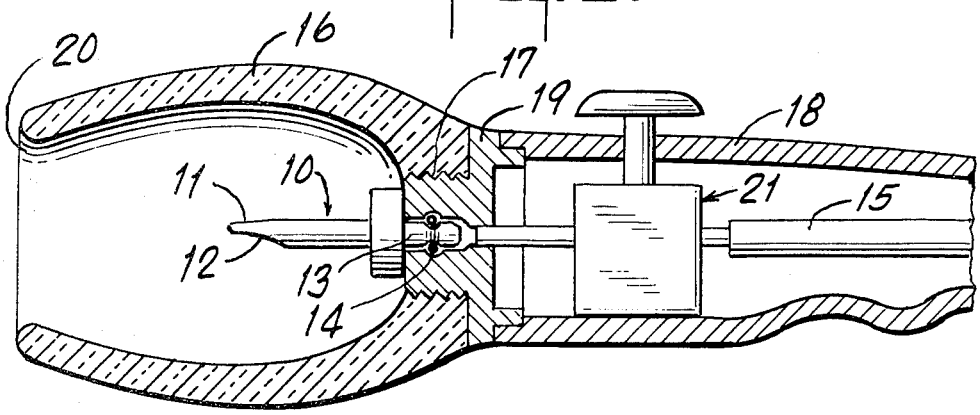
FIG. 2 is a cross-sectional view along the line 2—2 of FIG. 1 illustrating in detail a preferred nozzle.

Handle 18 attached to the spray shield permits the user of the appliance to hold the device and direct the liquid jet in an optimal fashion. The handle presently preferred comprises an elongated member provided with a series of finger grooves 22 for securely and easily grasping and holding the device. As shown in FIG. 2, the handle member may be substantially hollow and conduit means 14 may extend interiorly within the handle from the nozzle to the liquid supply or source.

The handle member may be constructed of plastic or any other suitable material, for example, plastics such as those used in the fabrication of the spray shield or less expensive plastic compounds containing pigments and fillers.

Figure 3:
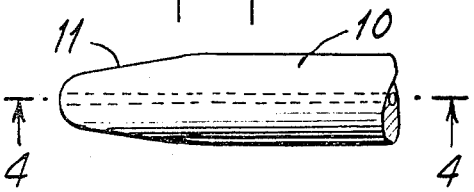
FIG. 3 is a plan view of a preferred form of nozzle.
Figure 4:
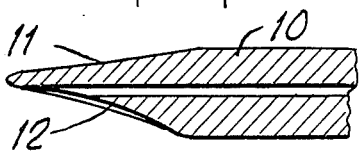
FIG. 4 is a cross-sectional view of the nozzle of FIG. 3, taken along the section plane 4—4.
Figure 5:
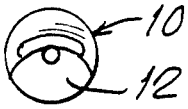
FIG. 5 is an end view in elevation of the nozzle of FIG. 3.

The water jet nozzle 10, illustrated in detail in FIGS. 3–5, is designed in such a manner as to permit easy insertion between the fingernail and the finger. This is done in much the same way as conventional manual fingernail cleaning devices. For purposes of clarification, a representative configuration is illustrated in FIG. 2. The shape of the nozzle is tapered and flattened with a blunt end and rounded corners in such a manner as to facilitate the gentle lifting of the nail without hurting the quick.

The spray shield may be mounted on the handle by any of a number of means including screw means such as by having the handle and spray shield appropriately threaded for mounting of the spray shield on the handle. Alternatively, the spray shield may be so constructed as to permit the shield to be "snapped onto" the handle. In still another embodiment, the handle may be constructed in two half sections held together by fastening means capable of holding the spray shield between the two halves when assembled.

The personal care appliance or manicure device is preferably provided with a finger pressure operated valve 21 for regulating the flow of liquid through the conduit means 14. When, as in FIG. 2, the handle member is substantially hollow and the conduit means extends interiorly therethrough, the finger pressure operated valve is preferably mounted in the handle in such a way that the valve can be readily engaged when the handle is grasped using the finger grooves.

The finger pressure operated valve 21 may be of any conventional type. Therefore, the valve illustrated in FIG. 2 is not shown in detail. Merely by way of example, the finger pressure operated valve may be a spring loaded valve so constructed that upon the application of pressure, the valve is opened and liquid may pass through the valve to the jet nozzle. Upon release of pressure, the valve is closed so that passage of liquid through to the nozzle is prevented. The finger pressure operated valve 21 may be so constructed and arranged that on release of pressure, the flow of liquid is diverted to an alternate flow path. The valve may also be located at the water source or other convenient place.

The personal care appliance of manicure device of the present invention may be so constructed that it is adapted for use with commercially available water pick dental hygiene appliances.

I claim:

1. A personal care appliance comprising a housing including a port through which the user's finger or toe may be inserted, said housing loosely surrounding said finger or toe; a nozzle means positioned within said housing for directing a liquid jet under the nail of the finger or toe inserted into said housing; means for supplying a stream of liquid to said nozzle and for discharging the liquid as a jet from said nozzle; and a handle member attached to said housing for holding said appliance and positioning said nozzle.

2. A personal care appliance as defined in claim 1 wherein said housing is barrel shaped including one closed end and one open end with said port in said open end, and said nozzle comprises a cylindrical tube having an axial conduit for said liquid and provided with a frusto-conical end section, said end section beveled at one side at an angle greater than the base angle of said frusto-conical end section and intersecting said axial conduit to provide a tip on the opposite side of said end section extending beyond the outlet of said conduit, whereby said tip when placed against the underside of a fingernail or toenail directs the stream of liquid under said nail.

3. A personal care appliance in accordance with claim 1 wherein the shape of said spray shield is substantially spherical or oblate.

4. A personal care appliance in accordance with claim 1 further provided with a chamber for containing cleaning solution along said conduit means whereby liquid carried along said conduit may be admixed with cleaning solution prior to discharge from said nozzle.

* * * * *